US010611605B2

(12) United States Patent
Halonen et al.

(10) Patent No.: US 10,611,605 B2
(45) Date of Patent: Apr. 7, 2020

(54) ELEVATOR CAR INCLUDING FLATBAR COVERING JOINT BETWEEN ADJACENT WALL ELEMENTS

(71) Applicants: Pekka Halonen, Tervakoski (FI); Aki Haikonen, Hyvinkaa (FI)

(72) Inventors: Pekka Halonen, Tervakoski (FI); Aki Haikonen, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 279 days.

(21) Appl. No.: 15/405,777

(22) Filed: Jan. 13, 2017

(65) Prior Publication Data

US 2017/0121153 A1 May 4, 2017

Related U.S. Application Data

(60) Division of application No. 14/260,820, filed on Apr. 24, 2014, now abandoned, which is a continuation of (Continued)

(51) Int. Cl.
*B66B 11/02* (2006.01)
*E04B 1/61* (2006.01)

(52) U.S. Cl.
CPC ..... *B66B 11/0253* (2013.01); *B66B 11/0226* (2013.01); *E04B 1/6141* (2013.01); *Y10T 29/49963* (2015.01)

(58) Field of Classification Search
CPC ..... B66B 11/0226; B66B 11/0253; E04B 1/6116; E04B 1/6133; E04B 1/6141; E04B 1/6166; E04B 1/617; E04B 1/6175
See application file for complete search history.

(56) References Cited

U.S. PATENT DOCUMENTS 850,275 A * 4/1907 Staples ..... E04B 1/6116 52/439
2,053,482 A 9/1936 Kellogg
(Continued)

FOREIGN PATENT DOCUMENTS

EP 0585945 A1 3/1994

OTHER PUBLICATIONS

International Search Report PCT/ISA/210 for International Application No. PCT/EP2011/0069604 dated Jul. 23, 2012.
(Continued)

*Primary Examiner* — Minh Truong
(74) *Attorney, Agent, or Firm* — Harness, Dickey and Pierce, P.L.C.

(57) ABSTRACT

The invention relates to an elevator car comprising a support frame, a floor structure and a ceiling structure, as well as at least one car door, and side walls extending between the floor structure and the ceiling structure, wherein the side walls are formed from several wall elements, which are aligned end-to-end or end-to side in corners, wherein the wall elements are composite panels consisting of at least one support material and at least one noise insulating material, that the elevator car comprises at least one flatbar, extending over the surface of both adjacent wall elements, and covering the joint between them, which flatbar comprises or is connectable with fixing elements to at least one of both adjacent wall elements. Via this means the joint between two noise insulating wall elements does prevent any essential noise leakage.

12 Claims, 5 Drawing Sheets

Figure 1:
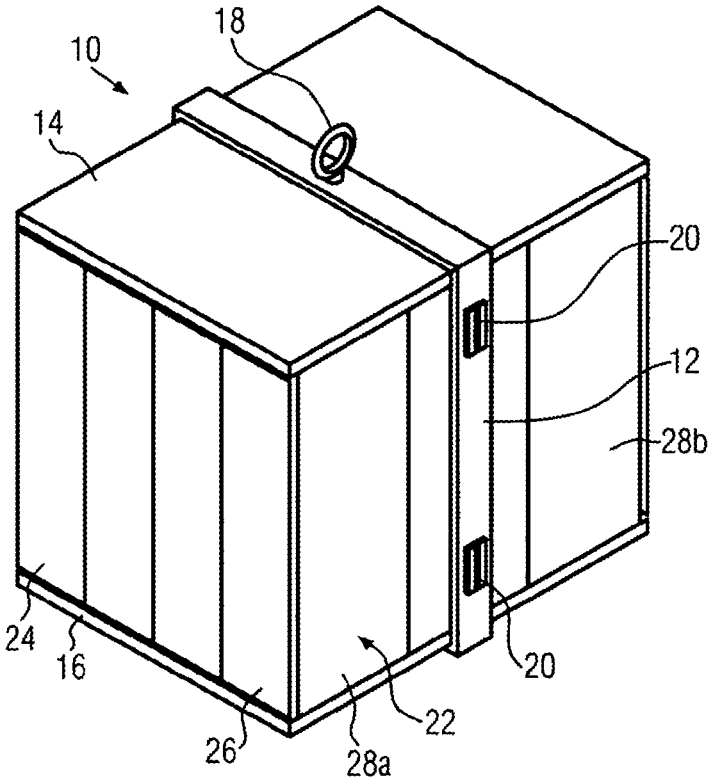

Related U.S. Application Data application No. PCT/EP2011/069604, filed on Nov. 8, 2011.

(56) References Cited

U.S. PATENT DOCUMENTS

| | | | | |
|---|---|---|---|---|
| 3,303,937 | A | 2/1967 | Kennedy | |
| 3,392,848 | A | 7/1968 | Kennedy | |
| 4,199,907 | A | 4/1980 | Bains et al. | |
| 4,251,969 | A | 2/1981 | Bains | |
| 4,266,386 | A | 5/1981 | Bains | |
| 4,422,277 | A | 12/1983 | Bains | |
| 4,430,838 | A | 2/1984 | Bains | |
| 4,435,935 | A * | 3/1984 | Larrea | E04B 1/617 52/461 |
| 5,454,449 | A | 10/1995 | Makimattila et al. | |
| 6,241,109 | B1 * | 6/2001 | Kautz | A47B 57/50 211/192 |
| 6,754,992 | B1 | 6/2004 | Byfield et al. | |
| 8,801,106 | B2 * | 8/2014 | Franklin | E02F 9/06 299/42 |
| 2002/0170242 | A1 * | 11/2002 | Skov | A47F 5/0815 52/79.1 |
| 2006/0289242 | A1 | 12/2006 | Oberer et al. | |
| 2014/0231183 | A1 * | 8/2014 | Halonen | B66B 11/0226 187/334 |

OTHER PUBLICATIONS

International Written Opinion PCT/ISA/237 for International Application No. PCT/EP2011/069604 dated Jul. 23, 2012.

* cited by examiner

ELEVATOR CAR INCLUDING FLATBAR COVERING JOINT BETWEEN ADJACENT WALL ELEMENTS

This is a divisional of U.S. application Ser. No. 14/260,820, filed on Apr. 24, 2014, which is a continuation of PCT International Application No. PCT/EP2011/069604, which has an international filing date of Nov. 8, 2011, the entire contents of each of which is incorporated herein by reference.

The present invention refers to an elevator car comprising a support frame, a floor structure and a ceiling structure, as well as at least one car door and side walls extending between the floor structure and the ceiling structure. As the elevator cars have various sizes according to the specified nominal capacity of an elevator, usually the side walls consist of several wall elements which are aligned end-to-end within one wall. In a corner of the elevator car where one side wall meets another side wall so that the wall elements to be connected are arranged perpendicular to each other the wall elements are arranged end to side. The present invention relates to this basic layout of an elevator car whereby it is particularly directed to high rise elevators or fast driving elevators where the noise of the fast running elevator car increases essentially compared to usual elevators with car velocities about 1 m/s. Elevator cars of such high rise elevators have velocities of two to ten m/s. Accordingly, there is a desire for elevator cars with a good noise insulation.

It is therefore object of the present invention to provide an elevator car with good noise insulation properties which can be easily configured to different cars sizes and which is fast and economic to build.

According to the invention wall elements are used with good noise insulating properties comprising at least one support material, e.g. panels of metal sheet, plastic panels or fiberboard plates (MDF) and at least one noise insulating material as e.g. stone wool or glass wool. For the wall elements also combinations of several support materials and noise insulating materials may be chosen as desired. The use of wall elements with good insulating properties essentially reduces the noise level in the elevator car even during fast travel of the elevator car in a high rise elevator. Furthermore, a particular joint is provided in the connection area of two adjacent wall elements. Accordingly, one flatbar is used which covers a part of both adjacent wall elements to be connected on both sides of the joint as well as the connecting area itself. This flatbar is connected with fixing elements to at least one of both adjacent wall elements, preferably to both adjacent wall elements. With this solution a kind of labyrinth seal is provided in the joint area between both adjacent wall elements which labyrinth seal has good noise insulating properties. Furthermore, the joint between the two wall elements is not leaking so that it does not allow noise to pass through. Furthermore, in case of any damage single wall elements may be changed or replaced one by one, if needed. The connecting of wall elements by means of the flatbars is fast and no special tools are needed.

Principally it is possible to fix the flatbar only to one of the adjacent wall elements. Advantageously, the flatbar is connected via fixing elements to both adjacent wall elements which results in a better rigidity of the joint and better noise insulating properties. As fixing elements bolts, particularly punch nuts may be used to fix the flatbar to the wall elements.

The flatbar maybe any longitudinal band, strip, sheet or bar, e.g. a metal or plastics sheet strip. The flatbar could be embodied as a one-piece element Which extends from the floor to the ceiling of the car, e.g. over the total height of the side walls, or it may comprise several parts are mounted above each other in vertical direction. Preferably the flatbar is an element which only extends in one plane and preferably having a thickness between 1 and 5 mm. Such a flatbar is easy to handle and allows a fast and economic joint between adjacent wall elements as it only has to be brought to the surfaces thereof and does not interfere with the inner structure or end structure of the wall elements.

Preferably the flatbar is mounted on the surface of the wall elements facing the car inside because in this case the side walls can be easily installed from the elevator car. But it is also possible to mount the flatbars on the side of the wall elements facing the shaft. If a very rigid construction is to be achieved the flatbars may be mounted on both sides of the wall elements.

On the side facing the wall elements the flatbar may comprise a sealing or damping material as e.g. rubber or soft plastics to improve the noise insulation in the area of contact to the wall element surface.

Preferably the flatbar comprises perforations which are to be penetrated by bolts for fixing the flatbar to one or both adjacent wall elements. This fixing of the flatbar to adjacent wall elements can be performed very easy and fast. By this way the vertical as well as horizontal mutual alignment and fixation of the wall elements is easy to achieve.

In an advantageous embodiment of the invention the perforations comprise first and second perforations and the first perforations extend over the first of two adjacent wall elements and the second perforations extend over the second of said wall elements. With this construction the flatbar can be easily mounted to both adjacent wall elements.

Preferably in this case the perforations comprise or consist of tilted portions, whereby the tilted portions of the first and second perforations are tilted towards each other. With such a configuration of the perforations it is possible to use the tilted portion for pressing the adjacent wall elements together by moving the flatbar vertically.

In an embodiment which is easy to manufacture the perforations are embodied as or comprise longholes, in which the bolts can easily slide in the direction of the longitudinal axis of the longholes.

Preferably, the perforations in the flatbar have a keyhole shape with one larger diameter hole connected to a longhole with a smaller width than the diameter of the hole, which larger diameter hole is larger than the diameter of the bolt heads. In this embodiment of the invention the bolts can be fixed to the wall elements in the perforation pattern of the flatbar without the necessity to arrange the flatbar in mounting position beforehand. After fixing of the bolts in said pattern in the wall elements the flatbar can be arranged in mounting position by simply putting it with the holes over the bolt heads so that the flatbar is held between the bolt heads and the wall elements. Preferably in this case the bolts are fixed in a first mounting position which still allows the movement of the flatbar with respect to the wall elements, i.e. the distance of the bolt heads to the wall element surface is slightly larger than the thickness of the flatbar.

In one alternative longholes of the first perforations are arranged side by side to the longholes of the second perforations. This arrangement is easy to handle. On the other side it is however possible to arrange the longholes of both perforations alternately in vertical direction.

Preferably several sets of two perforations located side by side are located in the flatbar at different height levels, e.g. 3 to 8 sets to provide a rigid and sealed connection between both adjacent wall elements.

In an advantageous embodiment of the invention the longholes or the tilted portions of the perforations are extending mainly vertically with a slight tilting angle to each other. The tilting angle may preferably be in a region of 5 to 45 degrees, preferably 10 to 25 degrees. Via this arrangement of the longholes the two adjacent wall elements are pressed. together by moving the flatbar in vertical direction so that the already pre-fixed bolts (mounted in the first mounting position) slide along the tilted longholes whereby the mutual distance of the longholes diminishes with the moving distance of the flatbar whereby the two bolts are pressed together by the longholes which also presses the noise insulating wall elements together. By this means a gap the joint between two wall elements can be avoided so that the joint between two adjacent wall elements is not noise leaking and the noise insulating properties of the wall elements are maintained also in the joints of the wall elements.

It shall be understood that any noise insulating structure panel comprising supporting material as well as insulating material can be used for the wall elements of the elevator car. The noise insulating material may be rockwool.

Preferably, the thickness of the wall elements in the area where the flatbar covers the wall element is reduced by the thickness of the flatbar (or by the thickness of the flatbar plus the thickness of the bolt heads) so that the mounted flatbar in alignment with the surface of the wall elements. Because of this the flatbar (and the bolts) do not hamper the mounting of the decorative panels on the inner side of the wall elements and/or the fixing of the side walls to additional support structures extending between the floor structure and the ceiling structure of the elevator car.

The invention of course also aims for an elevator comprising at least one elevator car according to the above given specifications.

The inventive method for mounting the side walls in the elevator car uses an elevator car consisting of a support frame, a floor structure and a ceiling structure, as well as at least one car door and side walls extending between the floor structure and the ceiling structure, wherein the side walls are formed from several wall elements, which are aligned end-to-end or end-to side in corners, wherein flatbars are used for the connection between two adjacent wall elements, which flatbars comprise perforations to be penetrated by bolts to be fixed to the wall elements, wherein the perforations in the flatbar comprise first perforations extending over the first of both adjacent wall elements which are to be connected and second perforations extending over the second of said adjacent wall elements, which perforations comprise longholes or tilted portions of the first and second perforations Which are tilted towards each other.

Of course, first the floor and ceiling structures of the elevator car have to be mounted to the car frame. Then the side walls of the elevator car are built up by connecting wall elements end to end. On this behalf two adjacent wall are located end to end so as to be in contact to each other. Then the bolts are fixed to the wall elements in line with the pattern of the holes in the flatbar in a first mounting position in which the bolt head has a sufficient distance from the wall element surfaces such that the movement of the flatbar with respect to the bolts is still possible. It is irrelevant whether flatbar is provided in its mounting place before or after fixing the bolts in their first mounting position in the wall elements.

After the bolts have been fixed in their first mounting position to the adjacent wall elements and the flatbar is mounted e.g. by putting the holes over the bolt heads, the flatbar is moved in vertical direction so that the flatbar grips the bolts in the longholes. Accordingly, by moving the flatbar in vertical direction so that the bolts travel away from the holes and into the longholes. With the further movement of the flatbar with respect to the wall elements the bolts are pressed by the longholes or tilted portions towards each other which leads to the fact that also the wall elements are pressed towards each other. Via this method a tight joint between two adjacent wall elements is provided which avoids any noise leakage. The vertical movement of the flatbar is stopped when the pressure between two wall elements is in a desired range which ensures that no gap is present any longer between the two wall elements. Afterwards the bolts are tightened (screwed) into a second mounting position. wherein the flatbar is tightly (immovable) pressed between the bolt heads and the wall element surfaces. This provides on optimal noise insulating joint with only minor mounting effort. No special tools are needed and the insulation can be performed without building stands on the shaft. The connection of the wall elements to the floor and ceiling structures is performed in line with adapted prior art technology. This also holds true for the mounting of the car doors and other structural elements of the elevator car.

It shall be clarified that the perforations can also be realized only by longholes without a larger diameter hole connected thereto. In this case the flatbar has to be brought into the mounting position before drilling the bolts into the wall elements.

It is further possible to place the longholes tilted in different directions vertically offset so that the two different longholes are not located side by side but vertically in different positions.

It shall be clarified that the flatbar can also be used for the connection of two wall elements in the corner of the car where the two adjacent wall elements are arranged perpendicular to each other. In this case one end of the first wall element is in contact with the surface of the second wall element.

For the desired tightening pressure effect on the adjacent wall elements the perforations do not need to be longholes, but both perforations needs to have a lifted portion whereby the tilted portions of both perforations are tilted towards each other which allows the bolts pressed together by a vertical movement of the flatbar. Preferably the tilted portion should be located in both perforations mutually at their opposite sides.

Furthermore, a flatbar may be located at the inner side and/or outer side of the elevator car.

It shall be understood that the joint line between panels could be other than a vertical one. Further the invention may be applied to other than elevator car panel joints.

The invention is now described in detail with reference to the embodiments in connection with the enclosed drawings.

Figure 2:
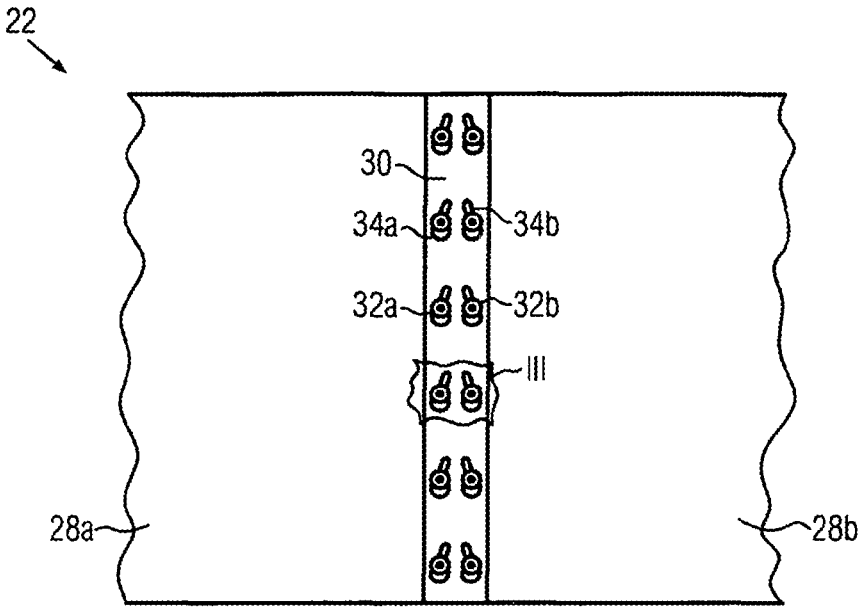
Figure 3:
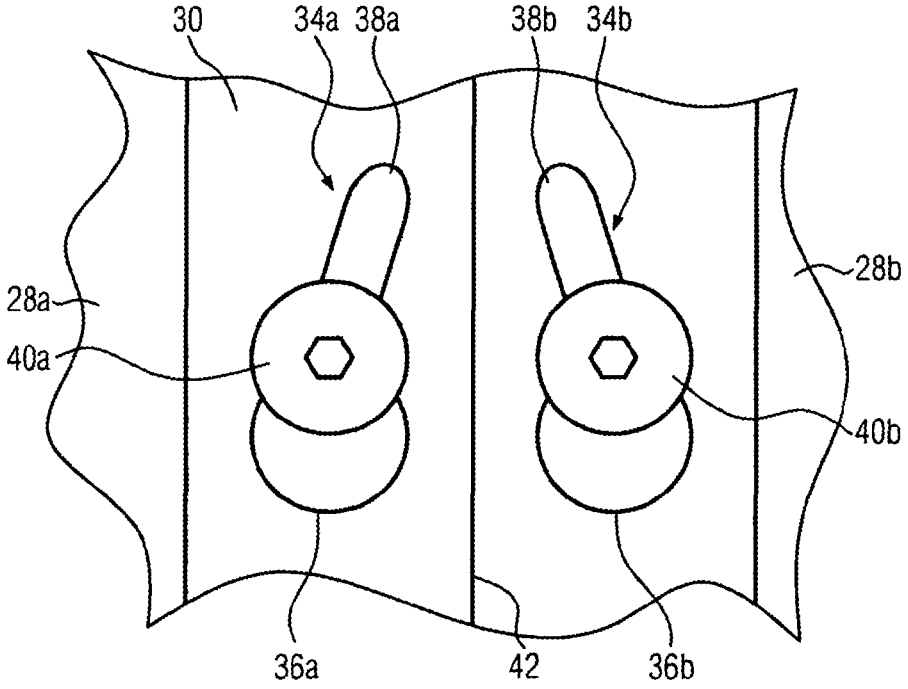
Figure 4:
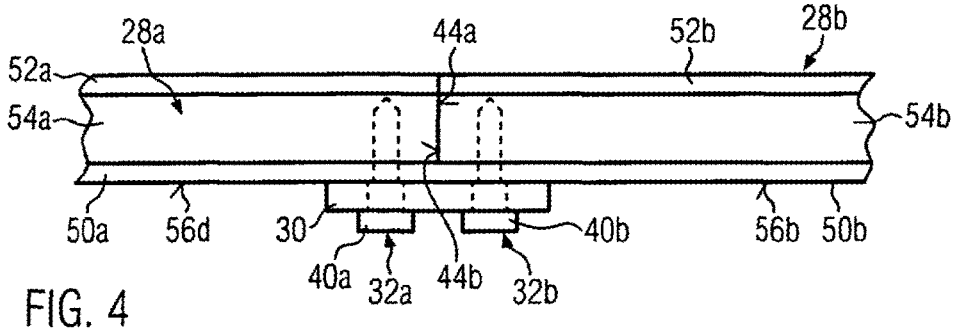
Figure 5:
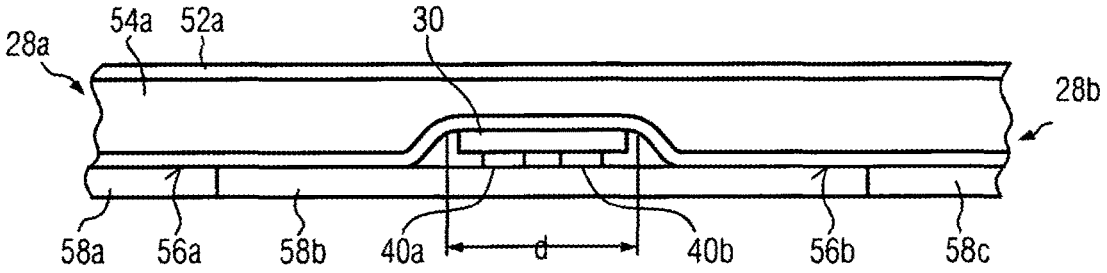
Figure 6:
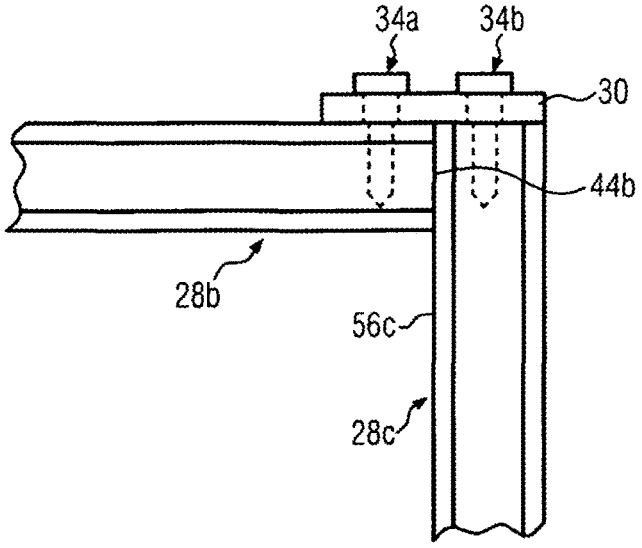
Figure 7:
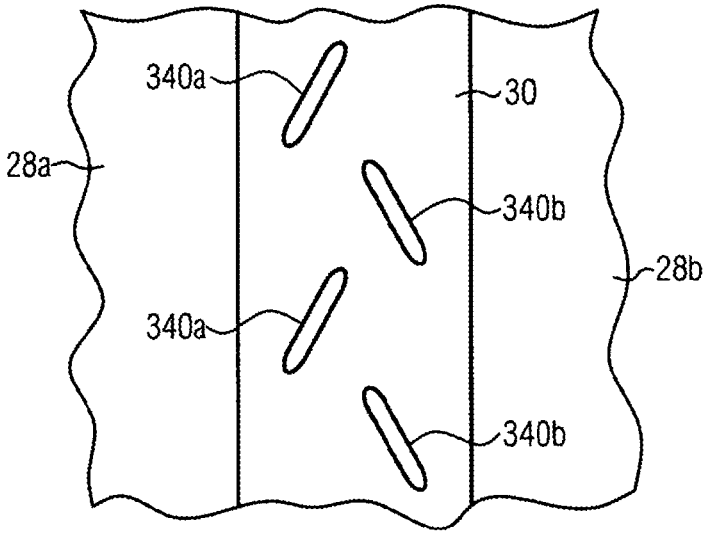
Figure 8:
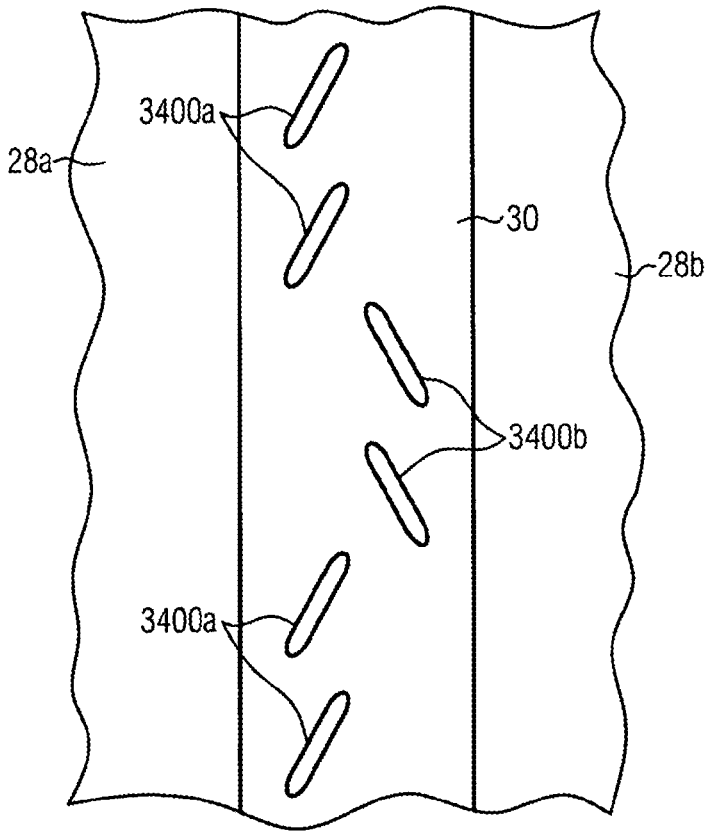
Figure 9:
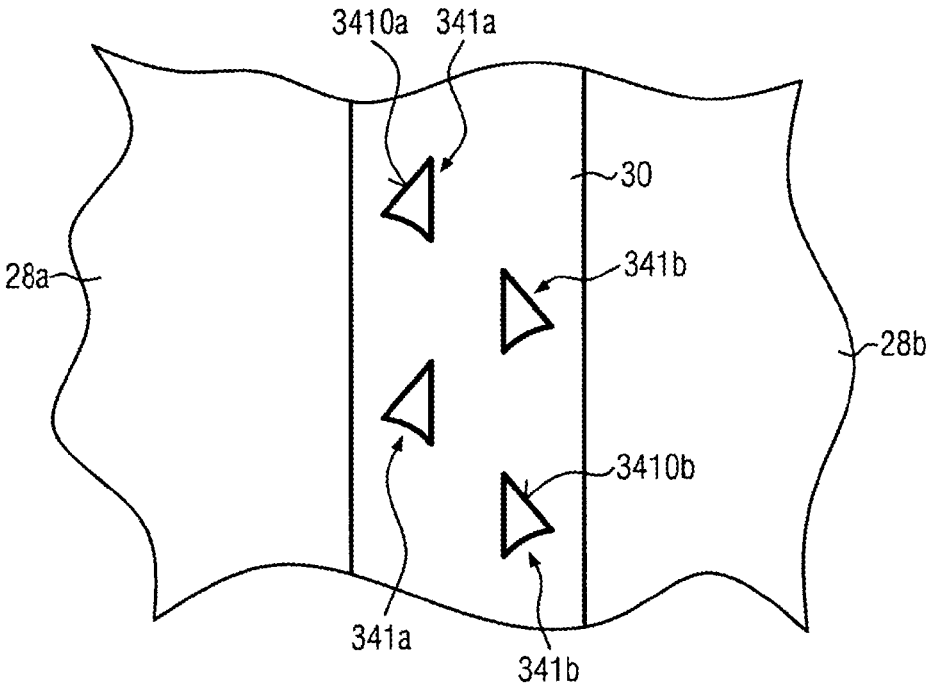

FIG. 1 shows a perspective schematic view of an elevator car,

FIG. 2 shows a detail from FIG. 1 showing two wall elements from the inner side of the elevator car connected by a flatbar, FIG. 3 shows an enlarged detail III from FIG. 2, FIG. 4 shows a cross sectional view of the joint region of two adjacent wall elements of a side wall, FIG. 5 shows a cross sectional view of the joint region of two wall elements carrying decorative panels, and FIG. 6 shows the joint region of two wall elements of perpendicular side walls in a car corner, FIG. 7 shows a side view of another embodiment of a joint between two wall elements showing another perforation pattern in a flatbar, FIG. 8 shows a side view of a third embodiment of a joint between two wall elements showing another perforation pattern in a flatbar, and FIG. 9 shows a side view of a fourth embodiment of a joint between two wall elements showing perforations with a tilted portion.

FIG. 1 shows an elevator car 10 having a car frame (or car sling) 12 carrying a ceiling structure 14 and a floor structure 16. The car frame 12 further comprises means for fixing suspension ropes, e.g. a diverting pulley 18 and means 24 for guiding the elevator car along guide rails. The elevator car has furthermore other components as e.g. gripping devices which are—like the suspension means 18 or the guiding means 20—not relevant for the present invention. Between the ceiling structure 14 and floor structure 16 side walls 22 extend in vertical direction. On at least one side of the elevator car elevator car doors 24, 26 are provided which are able to open the telescopic manner to allow entrance into the elevator car 10. The car doors may deviate from those shown in the figure. The embodiment and number of the car doors is not relevant for the invention. The side walls on the side and back of the elevator car consist of wall elements 28*a*, 28*b* which are connected in their end region whereby the joint between both wall elements 28*a*, 28*b*, 28*c* is connected via a flatbar 30 and bolts 32 in a manner which is described later on in more detail.

The invention relates to this connection between different side walls 28*a*, 28*b* and 28*c*. The wall elements 28*a*, 28*b*, 28*c* are connected to the floor structure 16 and the ceiling structure 14 in a per se known manner.

FIG. 2 shows the joint between two wall elements 28*a*, 28*b* of a side wall 22 in a more detailed manner from the inner side of the elevator car. The flatbar 30 is a strip of metal sheet extending vertically and covering the surface 56*b*, 56*d* of adjacent wall elements 28*a*, 28*b* (see also FIG. 4) which are arranged end-to-end.

The flatbar 30 has several sets of keyhole perforations 34*a*, 34*b* located side by side which are shown in more detail in FIG. 3. Each keyhole perforation 34*a*, 34*b* has a circular hole 36*a*, 36*b* with a larger diameter connected to a longhole or slot 38*a*, 38*b*.

The diameter of the holes 36*a*, 36*b* is slightly larger than the diameter of the bolt head 40*a*, 40*b*. The longholes or slots 38*a*, 38*b* of one pair of perforations extend essentially vertically but are slightly inclined in an angle of 5-30 degrees relative to each other. Accordingly, the right keyhole perforation 34*a*, 34*b* is identical to the left keyhole perforation 34*a* but mirrored with respect to the center axis 24 of the flatbar 30.

As is it derivable from FIG. 2 the flatbar 30 comprises several pairs of the side by side perforations 34*a* and 34*b* at different height levels.

The fixing of two wall elements 28*a*, 28*b* is performed as follows:

First the two wall elements 28*a*, 28*b* to be connected are located side by side so that their end faces 44*a*, 44*b* are in contact. Thereafter bolts 32*a*, 32*b* are drilled into the wall elements 28*a*, 28*b* in a pattern corresponding to the pattern of the holes in the flatbar. The bolts 32*a*, 32*b* are not drilled up to the end but to a first mounting position which ensures the movement of the flatbar between the corresponding bolt heads 48*a*, 48*b* and the surface of the wall elements 28*a*, 28*b*. After having the bolts 32*a*, 32*b* fixed to both wall elements 28*a*, 28*b* the flat bar is put onto the bolts so that the bolt heads 48*a*, 48*b* pass through the holes 36*a*, 36*b* of the flatbar. Then the flatbar is moved downwards whereby the two bolts 34*a*, 34*b* which are fixed to the different wall elements 28*a*, 28*b* are pressed together via the tilted longholes. By this action both wall elements 28*a*, 28*b* are pressed together so that any gap between the two end faces 44*a*, 44*b* of the two wall elements is removed. Now the bolts 32*a*, 32*b* are fixed into their second mounting position where they press the flatbar 30 tight (immovable) between the bolt heads 48*a*, 48*b* and the surface of the wall elements 28*a*, 28*b*.

On the other side the flatbar 30 forms together with the wall elements 28*a*, 28*b* a kind of labyrinth seal with also prevents noise from passing through the joint between both wall elements.

FIG. 4 further shows that each wall element 28*a*, 28*b* consists of two metal sheets 50*a*, 50*b* and 52*a*, 52*b* (hereinafter referred to as metal sheets 50, 52, respectively, in FIG. 4) between which a noise insulating layer 54*a*, 54*b* (hereinafter referred to as noise insulating layer or noise insulating material 54) is arranged which is for example stone wool, rockwool, glass wool or any other noise insulating material. It is also possible that the metal sheets 50, 52 have anchors or fixing elements to improve the connection between the sheet 50, 52 and the noise insulating material 54. The metal sheets 50, 52 may also have perforations which are penetrated by the noise insulating material to improve the mutual connection of these layers. Of course, the layers can be arranged differently from the arrangement shown in FIG. 4.

FIG. 5 shows the same view as FIG. 4 with a different embodiment wherein within the width d the flatbar 30 the thickness of the wall elements 28*a*, 28*b* is reduced by the thickness of the flatbar 30 and the thickness of the bolt heads 40*a*, 40*b*. In this arrangement the surface of the bolt heads 40*a*, 40*b* is aligned with the surface 56*a*, 56*b* of the wall elements 28*a*, 28*b*. This facilitates or enables the mounting of decorative panels 58*a*, 58*b*, 58*c* on the inner surface of the wall elements 28*a*, 28*b*. Decorative panels 58*a*, 58*b*, 58*c* could be made for example from marble, metal or wood according to the desired design of the customer. At it is clearly seen from FIG. 5 the flatbar 30 and the bolt heads 48*a*, 48*b* do not interfere with the mounting of the decorative panels 58*b* on the inner surface 56*a*, 56*b* of the wall elements 28*a*, 28*b*.

FIG. 6 shows the mounting of two wall elements 28*b*, 28*c* in the corner region of the elevator car 10, wherein the wall elements 28*b*, 28*c* are perpendicular to each other. In this embodiment the end face 44*b* of the first wall element 28*b* is connected to the surface 56*c* of the other wall element 28*c*. The joint region between both wall elements 28*b*, 28*c* is again covered with a flatbar 30 which is fixed to both wall elements with bolts 34*a*, 34*b* in the same manner as it has been discussed in connection with FIGS. 2 to 4.

FIGS. 7 and 8 show different patterns of perforations in the flatbar 30.

In FIG. 7 the perforations only consist of longholes 340*a,b*. Anyway instead of longholes they may consist of keyhole perforations as shown in FIG. 3. In this embodiment the perforations 340*a* to be connected with the first wall element 28*a* and the perforations 340*b* to be connected with the second wall element 28*b* are vertically offset, so that they are arranged in vertical direction in an alternating succession.

In FIG. 8 the perforations 3400*a* to be connected with the first wall element 28*a* and the perforations 3400*b* to be connected with the second wall element 28*b* are vertically offset, but in a way that always two first perforations 3400*a* of follow two second perforations 3400*b* in vertical direction, which pattern is repeated along the vertical axis of the flatbar.

According to FIG. 9 instead of tilted longholes the perforations 341*a*, 341*b* may have any shape which comprises a tilted portion 3410*a,b* whereby the tilted portion 3410*a,b* of both perforations 341*a,b* is mirrored against the center line 24 of the flatbar 30 so that the inclined or tilted portions 3410*a,b* of both perforations 341*a,b* are tilted towards each other. The tilted portion should be located in both perforations mutually at their opposite sides (i.e. facing away from each other).

It should be clear for the skilled person that the above mentioned embodiments are not restricting the invention but the invention may be carried out within the scope of the appended patent claims.

The frame of the elevator car may deviate from the one shown in FIG. 1. Accordingly, it may consist of several parallel multiple frame parts arranged side by side. Furthermore, the connection of the floor and ceiling structures 16, 14 to the frame 12 is not relevant for the invention.

The connection of the wall elements 28*a*, 28*b*, 28*c* to the floor or ceiling structures 16, 14 is performed in line with prior art. Furthermore, the connection of the wall elements 28 to door sections of the car is realized in line with prior art technology and not part of the invention.

Of course there may he several car doors on different positions of the elevator car for example in the front and back. Furthermore, the car doors may be turn doors instead of telescopic doors or sliding doors.

On the inner side of the wall elements decorative panels may be fixed. Furthermore on the outer side of the wall elements 28*a*, 28*b*, 28*c* supporting structures maybe located as e.g. a supporting wall or supporting beams to which the wall elements are fixed in a per se known manner.

The invention claimed is:

1. An elevator car comprising:

a support frame;

a floor structure;

a ceiling structure;

at least one elevator car door;

side walls extending between the floor structure and the ceiling structure, the side walls including a plurality of wall elements aligned end-to-end or end-to-side at corners of the elevator car to form joints between adjacent ones of the plurality of wall elements, the plurality of wall elements being composite panels including at least one support material and at least one noise insulating material; and at least one flatbar extending over a surface of a joint between a set of adjacent wall elements from among the plurality of wall elements, the at least one flatbar being configured to cover the joint between the set of adjacent wall elements, and the at least one flatbar being configured to be fixed to at least one wall element in the set of adjacent wall elements;

wherein the at least one flatbar has perforations configured to allow at least two bolts that are respectively fixed to a wall elements in the set of adjacent wall elements to pass through the at least one flatbar, a first set of the perforations extend over a first of the wall elements in the set of adjacent wall elements, a second set of the perforations extend over a second of the wall elements in the set of adjacent wall elements, the first set of the perforations have first tilted portions, the first tilted portions tilted relative to a longitudinal axis of the at least one flatbar, the second set of the perforations have second tilted portions, the second tilted portions tilted relative to the longitudinal axis of the at least one flatbar, the first tilted portions are tilted towards the second tilted portions, and the wall elements at the joint between the set of adjacent wall elements have reduced thicknesses relative to remaining portions of the wall elements in the set of adjacent wall elements, wherein the reduced thicknesses correspond to a sum of a thickness of one of the at least one flatbar and a thickness of a head of one of the at least two bolts such that a vertical surface of the head of each of the at least two bolts is coplanar with vertical surfaces of the remaining portions of the wall elements that are adjacent to the joint.

2. The elevator car according to claim 1, wherein the at least one flatbar is configured to be fixed to each of the wall elements in the set of adjacent wall elements.

3. The elevator according to claim 1, wherein the first and second tilted portions are longholes.

4. The elevator according to claim 3, wherein each of the perforations in the at least one flatbar has a keyhole shape with a larger diameter hole connected to a corresponding longhole, the corresponding longhole having a width smaller than a diameter of the larger diameter hole, and the larger diameter hole being larger than a diameter of the head of a corresponding bolt from among the at least two bolts.

5. The elevator car according to claim 3, wherein the longholes of the first set of the perforations and the longholes of the second set of the perforations are arranged side-by-side.

6. The elevator car according to claim 1, wherein the bolts extend through the at least one flatbar and are anchored in the wall elements.

7. The elevator car according to claim 1, wherein the at least one support material is sheet metal.

8. The elevator car according to claim 1, wherein the at least one noise insulating material is rockwool.

9. The elevator car according to claim 1, wherein the at least one flatbar is a strip of sheet metal.

10. An elevator comprising an elevator car according to claim 1.

11. The elevator car of claim 1, further comprising:

at least one decorative panel mounted on at least one of the plurality of wall element and covering the flatbar, the head of each of the at least two bolts, and the remaining portions of the wall elements that are adjacent to the joint.

12. A method of building an elevator car including a support frame, a floor structure, a ceiling structure, at least one car door, side walls extending between the floor structure and the ceiling structure, and at least one flatbar, wherein the side walls include a plurality of wall elements aligned end-to-end or end-to-side at corners of the elevator car to form joints between adjacent ones of the plurality of wall elements, and wherein the at least one flatbar extends over a surface of a joint between a set of adjacent wall elements from among the plurality of wall elements, and wherein wall elements at the joint between the set of adjacent wall elements have reduced thicknesses relative to remaining portions of the wall elements in the set of adjacent wall elements, the method comprising:

arranging the wall elements in the set of adjacent wall elements end-to-end or end-to-side at the corner of the elevator car;

fixing at least a first bolt to a first of the wall elements in the set of adjacent wall elements into a first fixing position, the first bolt not being driven into the first wall element to allow the at least one flatbar to be movable with respect to the first bolt;

fixing at least a second bolt to a second of the wall elements in the set of adjacent wall elements into a second fixing position, the second bolt not being driven into the second wall element to allow the at least one flatbar to be movable with respect to the second bolt, the first and second bolts being fixed at a distance corresponding to a pattern of perforations in the at least one flatbar;

moving the at least one flatbar in a vertical direction relative to the first and second bolts to bring the first and second wall elements together; and fixing, in a vertical position at which the first and second wall elements are closed together, the first and second bolts in a second fixing position in which the at least one flatbar is pressed tightly between the first and second wall elements and heads of the bolts, wherein the reduced thicknesses correspond to a sum of a thickness of one of the at least one flatbar and a thickness of one of the heads of the bolts such that vertical surfaces of the heads of the bolts are coplanar with vertical surfaces of the remaining portions of the wall elements that are adjacent to the joint.

* * * * *